US006312480B1

(12) United States Patent
Jakob et al.

(10) Patent No.: US 6,312,480 B1
(45) Date of Patent: Nov. 6, 2001

(54) SOLID FUEL ADDITIVE

(75) Inventors: Claus Peter Jakob, Viernheim; Christoph Bähr, Meckenheim; Harald Schwahn, Wiesloch; Dietmar Posselt, Heidelberg, all of (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/601,018

(22) PCT Filed: Feb. 5, 1999

(86) PCT No.: PCT/EP99/00778

§ 371 Date: Jul. 25, 2000

§ 102(e) Date: Jul. 25, 2000

(87) PCT Pub. No.: WO99/40166

PCT Pub. Date: Aug. 12, 1999

(30) Foreign Application Priority Data

Feb. 6, 1998 (DE) ..... 198 04 756

(51) Int. Cl.[7] ..... C10L 1/22; C10L 1/18
(52) U.S. Cl. ..... 44/412; 44/434
(58) Field of Search ..... 44/412, 434

(56) References Cited

U.S. PATENT DOCUMENTS

| | | | | |
|---|---|---|---|---|
| 4,515,740 | * | 5/1985 | Schuettenberg et al. | 264/50 |
| 4,639,255 | | 1/1987 | Schuettenberg et al. | 44/62 |
| 5,720,782 | | 2/1998 | Schilowitz et al. | 44/300 |

FOREIGN PATENT DOCUMENTS

| | | |
|---|---|---|
| 2 143 140 | 8/1996 | (CA) . |
| 41 28 381 | 3/1993 | (DE) . |
| 44 31 409 | 3/1996 | (DE) . |
| 44 34 603 | 4/1996 | (DE) . |
| 2 557 587 | 7/1985 | (FR) . |
| 2 079 783 | 1/1982 | (GB) . |
| 2 131 452 | 6/1984 | (GB) . |

OTHER PUBLICATIONS

Rossenbeck "Katalysatoren, Tenside und Mineralökadditive" G. Thieme Verlag (1979) pp. 223–229.

* cited by examiner

*Primary Examiner*—Margaret Medley
*Assistant Examiner*—Cephia D. Toomer
(74) *Attorney, Agent, or Firm*—Keil & Weinkauf

(57) ABSTRACT

Solid or pasty fuel additive compositions comprise a homogeneous mixture of a solid compacting agent soluble in fuel and at least one liquid fuel additive, the compositions having an additive content of from more than about 40 to 99% by weight, based on their total weight.

12 Claims, No Drawings

SOLID FUEL ADDITIVE

This application is a 371 of PCT/EP99/00778 filed Feb. 5, 1999.

The present invention relates to solid or pasty additive composition for fuels.

Carburettors and intake systems of gasoline engines as well as injection systems for fuel metering in gasoline and diesel engines are being increasingly contaminated by impurities. The impurities are caused by dust particles from the air sucked in by the engine, uncombusted hydrocarbon residues from the combustion chamber and the crankcase vent gases passed into the carburettor.

These redidues shift the air/fuel ratio during idling and in the lower part-load range so that the mixture is richer and the combustion bustion more incomplete. As a result, the proportion of uncombusted or partially combusted hydrocarbons in the exhaust gas and the gasoline consumption increase.

It is known that fuel additives for keeping valves and carburettor or injection systems clean are used for avoiding these disadvantages (cf. for example: M. Rossenbeck in Katalysatoren, Tenside, Mineralöladditive, Editors J. Falbe and U. Hasserodt, page 223, G. Thieme Verlag, Stuttgart 1978). Depending on the mode of action and preferred place of action of such detergent additives, a distinction is now made between two generations of additives. The first generation of additives was able only to prevent the formation of deposits in the intake system but not to remove existing deposits. On the other hand, additives of the second generator ration prevent and eliminate deposits. They thus exhibit both a keep-clean effect and a clean-up effect. This is permitted in particular by their excellent heat stability in zones of relatively high temperature, in particular in the intake valves.

Such detergents, which may originate from many classes of chemical substances, are generally used in combination with carrier oils and, if required, further additive components, for example corrosion inhibitors and demulsifiers. These liquid additive formulations are added as a rule by means of suitable metering apparatuses to the fuel, where they display their action. However, in the storage and distribution of fuels, there are also cases where no suitable metering facility for liquid fuel additives is available. Here, the existence of fuel additives in solid form which dissolve in fuels would be helpful and advantageous. They would constitute a considerable improvement compared with liquid additives, since the technical complexity and high cost of a metering apparatus would be dispensed with.

DE-A-44 31 409 discloses a pumpable fuel additive paste which can be metered directly into the fuel feed line. The paste has an additive content of from about 5 to 35% by weight and contains from 10 to 60% by weight of oils, fats and/or waxes and from 1 to 10% by weight of a thickener, e.g. bentonite. A disadvantage of such fuel additive formulations is the poor handling properties of the pasty product and the high technical complexity for metering the paste into the fuel.

CA-A-2 143 140 discloses solid additives for internal combustion engines. The solid formulation is prepared by adsorbing a liquid additive onto a porous, solid fuel-soluble carrier, preferably a naphthalene-based carrier, and closing the pores of the carrier after adsorption of the additive. A disadvantage of these solid additives is their inconvenient preparation process. A further serious disadvantage is the limited adsorptivity of the naphthalene pellets used. For example, it is stated that a 1.6 g pellet can typically absorb only an amount of additive which corresponds to one third of its volume.

U.S. Pat. No. 4,639,255 discloses various solid fuel additive composition According to a first embodiment described therein, a pelleted additive formulation which has an additive content of from about 25 to about 75% by weight, based on the weight of the composition, is provided. The additive is contained in a fuel-dis-persible compacting agent, for example paraffin wax, and the additive pellets are sealed on their surface. Examples of preferred additives are hydrogenated polybutenes having a molecular weight of from about 700 to about 1100 and the reaction products of one or more vegetable oils and a polyethyleneimine, additionally derivatized with a sulfonic acid. U.S. Pat. No. 4,639,255 furthermore describes solid fuel additive formulations which contain, as a compacting agent, an aromatic hydrocarbon, for example naphthalene or the readily subliming durene (1,2,4,5-tetramethylbenzene), in an amount of from about 50 to 95% by weight. A further solid additive formulation contains, in addition to a compacting agent, a long-chain alcohol as a modifier for increasing the melting point. Another solid additive formulation has an additive content of from 5 to 40% by weight, the additive pellets having a coating of foamed paraffin wax. Finally, U.S. Pat. No. 4,639,255 describes an additive formulation having a foamed carrier. All of the solid additive formulations described above are still not completely satisfactory with respect to their additive content and/or owing to their relatively complicated preparation. U.S. Pat. No. 4,639,255 expressly points out to persons skilled in the art that the additive content in uncoated formulations may be not more than 40% by weight and should preferably be from about 10 to 30, in particular from about 15 to 25, % by weight.

It is an object of the present invention to provide solid or pasty fuel additive formulations which are distinguished both by a high additive content and by simple preparation. In particular, it is intended to provide highly concentrated, solid or pasty detergent additive formulations.

We have found that this object is achieved, surprisingly, by providing a fuel additive composition which is nonfluid, solid or pasty under standard conditions of temperature and pressure, can be used in particular in gasoline fuels and comprises a preferably homogeneous mixture of a solid compacting agent soluble or dispersible in fuel and at least one liquid fuel additive, the composition having an additive content of from more than 40 to about 99, preferably from about 50 to 95, for example from about 60 to 90, % by weight or from about 75 to 90% by weight, based on its total weight.

The novel additive compositions have the advantage that, owing to their high additive content, they have substantially improved performance. Furthermore, they have the advantage that they can be simply prepared by incorporating the additive or additives into, for example, a melt of the compacting agent which is solid at ambient temperature, homogenizing the mixture, if required allowing it to cool and fabricating it in a suitable manner. It is not necessary either to foam the compacting agent or to subject the solid formulation, for example, processed to give pellets, to surface treatment. The novel formulations also have the advantage that they can be added to fuel without a pump apparatus. Furthermore, the dosage can be more easily adjusted and the viscosity requirements of the additive-containing product are easier to meet.

Statements on the state of aggregation, such as solid, liquid or pasty, are made in the context of the present description with reference to standard conditions of temperature and pressure, i.e. about 20° C. and about 1 atm pressure.

A novel solid or pasty composition has a melting range or a melting point of about 25–95° C., preferably about 30–90° C., in particular about 35–70° C., for example from about 35 to 50° C.

Unless stated otherwise, the additive contents mentioned in the context of the present invention are the sum of the contents of all components for the respective formulation other than the compacting agent.

A homogeneous composition is present if no phase boundaries or separation regions are visually detectable in the novel solid.

In a preferred embodiment, the novel compositions contain at least one detergent additive as the main additive component. In particular, additives which both prevent the formation of deposits in the intake valves and eliminate already formed deposits are used. They thus exhibit both a keep-clean effect and a clean-up effect.

Additives suitable according to the invention are selected from polyetheramines, for example poly-$C_2$–$C_6$-alkyleneoxyamines, and polyakeneamines, such as poly-$C_2$–$C_6$-alkeneamines, and functional derivatives thereof. Particularly preferred detergent additives are selected from polyisobuteneamines and functional derivatives thereof. The polyisobutene part of these additives can be prepared for example from a $C_4$ cut which is usually obtained from thermal or catalytic cracking and which has a high isobutene content by means of e.g. cationic polymerization. The polyisobutene part can also be derived from mixtures of n-butene and i-butene, e.g. by cationic polymerization, where the molar ratio of n-butene and i-butene can be chosen freely, and for example can be freely adjusted in a range from 1:20 to 20:1, e.g. 1:10 to 10:1. The polyisobutene part can also be derived from substantially pure i-butene, e.g. by cationic polymerization and thus contains about 100% units of i-butene in polymerized form. Preferably the above polyalkyleneamines are prepared from so-called reactive polyalkene which is known from prior art. This has preferably a high content of terminal double bonds, e.g. of about ≧50% or ≧70% or ≧90%. According to the invention, a functional derivative is understood as meaning chemically modified detergent additives which have a clean-up effect which is qualitatively comparable but not necessarily completely identical in level or intensity to that of a detergent additive.

The detergent additives preferably used according to the invention are known per se from the prior art. Polyisobuteneamines are described, for example, in EP-A-0 244 616 and EP-A-0 578 323. Further detergent additives suitable according to the invention are described, for example, in European Patent Applications EP-A-0 277 345, 0 356 725, 0 476 485, 0 484 736, 0 539 821, 0 543 225, 0 548 617, 0 561 214, 0 567 810 and 0 568 873; in German Patent Applications DE-A-39 42 860, 43 09 074, 43 09 271, 43 13 088, 44 12 489, 0 44 25 834, 195 25 938, 196 06 845, 196 06 846, 196 15 404, 196 06 844, 196 16 569, 196 18 270 and 196 14 349; and in WO-A-96/03479. Particularly useful liquid detergent additives are sold by BASF AG, Ludwigshafen under the tradename Kerocom® PIBA. These contain polyisobuteneamines dissolved in aliphatic $C_{10-14}$-hydrocarbons.

Detergent additives used according to the invention, in particular the preferably used polyisobuteneamine additives, usually have a number average molecular weight Mn of from about 150 to about 5000, preferably from about 500 to about 2000, in particular from about 800 to 1500, g/mol.

The content of detergent additive, for example polyisobuteneamines and the functional derivatives thereof, is from about 20 to 100, preferably more than 30, in particular more than 40, % by weight, for example from about 45 to 70% by weight, based on the total weight of the additives contained in the novel composition. If the detergent additive component is present in such an amount, the term main additive component of the composition is used in the context of the present invention.

The amount of detergent additive may be, for example, more than about 10% by weight, for example from 15 to 30% by weight or more, such as from about 40 to 99% by weight or from 50 to 95% by weight, or from 60 to 90% by weight or from 75 to 90% by weight, based on the total weight of the solid or pasty additive formulation.

In addition to the detergent additive, further conventional fuel additives and other additives may be present, for example corrosion inhibitors, demulsifiers and dyes. If necessary, carrier oils may also be added.

Examples of useable carrier oils or carrier liquids are mineral carrier oils, synthetic carrier oils and mixtures thereof which are compatible with the additive or additives used and the fuel. Suitable mineral carrier oils are fractions obtained in mineral oil processing, such as kerosene or naphtha, Brightstock or mineral oils having a viscosity of SN 500–900, as well as aromatic hydrocarbons, paraffinic hydrocarbons and alkoxyalkanols.

Examples of suitable synthetic carrier oils are polyolefins, (poly)esters, (poly)alkoxylates and in particular aliphatic polyethers, aliphatic polyetheramines, alkylphenol-initiated polyethers and alkylphenol-initiated polyetheramines. Suitable carrier oil systems are described, for example, in DE-A-38 38 918, DE-A-38 26 608, DE-A-41 42 241, DE-A-43 09 074, U.S. Pat. No. 4,877,416 and EP-A-0 452 328, which are hereby expressly incorporated by reference. Examples of particularly suitable carrier oils are alcohol-initiated polyethers having from about 15 to 30, for example from about 20 to 25, $C_3$–$C_6$-alkylene oxide units, for example selected from propylene oxide, n-butylene oxide and isobutylene oxide units or mixtures thereof.

A typical additive mixture contained in a novel composition comprises, for example, a) from about 20 to 80, preferably from about 60 to 80, % by weight of at least one polyisobuteneamine or one functional derivative thereof, b) from about 20 to 80, preferably from about 20 to 40, % by weight of at least one synthetic carrier liquid, for example an alkylphenol-initiated polyether, for example composed of from about 15 to 30, for example from about 20 to 25, $C_3$–$C_6$-alkylene oxide units, for example propylene oxide, n-butylene oxide or isobutylene oxide units or mixtures thereof, and/or at least one mineral oil-based carrier oil, and c) from 0 to about 5, preferably from about 1 to 4, % by weight of at least one further additive of the above-mentioned type but differing from a), the stated weights being based on the total weight of the components a), b) and c) added to the compacting agent. Suitable additive mixtures have, for example, a boiling point of above 120° C., for example of above 150 or 180° C., a density (15° C., DIN 51757) of from about 0.8 to 0.9 g/cm$^3$ and a viscosity (20° C., DIN 51562) of from about 50 to 200, for example from about 70 to 160, mm$^2$/s. Such additive mixtures are available as commercial products, for example under the tradename Keropur® 3222, 3131 and ES 3401.

The compacting agent used for the preparation of the novel additives is preferably fuel-soluble and usually has a melting point or softening point above the corresponding values of the prepared composition, for example from about 30 to 100° C., preferably from about 30 to 90° C., in particular from 40 to 70° C. In particular, the compacting agent is selected from fuel-soluble (a) natural waxes, for example petrochemical waxes, in particular paraffin wax and vaseline; (b) chemically modified waxes, for example hard waxes, and (c) synthetic waxes, for example polyethylene wax and high molecular weight polyisobutene (cf. for example Ullmann's Encyclopädie der Technischen Chemie, third edition, Vol. 18, page 262 et seq.). Some examples of suitable fuel-soluble waxes are also disclosed in U.S. Pat. No. 4,639,255. The abovementioned publications are hereby expressly incorporated by reference. Mixtures of the above compacting agents may also be used.

Compacting agents suitable according to the invention have a fuel solubility of up to about 10%, based on the weight of the fuel used.

The novel fuel additive compositions can be prepared in a simple manner using generally known methods. For this purpose, the compacting pacting agent is preferably heated to its softening temperature, the fuel additive or the additive mixtures and, if required, the carrier oil are added while stirring and stirring is continued until a homogeneous mixture has formed. The liquid mixture is then allowed to solidify. It is also possible to incorporate the additive into the compacting agent by kneading or by melt extrusion. The prepared composition is then fabricated by extrusion or pelleting. It is also possible to provide the compositions in pill or powder form. Encapsulation of pellets or pills is possible but not necessary.

The novel additive compositions can be added to the fuel without particular technical apparatuses, for example directly after loading into the tanker truck. The metered units, for example pellets are added in an amount required to establish a detergent additive concentration of from about 20 to 5000, for example about 400–900, mg/kg of fuel.

The examples which follow illustrate the invention. Unless stated, otherwise, the density determination is carried out according to DIN 51757 and the viscosity determination according to DIN 51562.

EXAMPLE 1

Preparation of a Solid Additive Composition a) 100 g of a conventional additive composition for gasoline fuels (Keropur® 3222) (boiling point: >165° C., density (15° C.)=0,865 g/ml; viscosity (20° C.)=120 $mm^2/s$; 25% by weight of polyisobuteneamine, Mn=1000, as detergent) is mixed with half the amount of a molten commercial hard paraffin (melting point=55° C.) while stirring. After homogenization of the mixture, it is allowed to cool to room temperature, the paraffin solidifying again and the additive being encapsulated. The solid fuel additive thus prepared is soluble in conventional fuels.

b) Example 1a) was repeated, but additive and hard paraffin were used in a ratio of 1:1. A solid fuel additive composition soluble in fuel is likewise obtained.

EXAMPLE 2

Preparation of a Solid Additive Composition 80 g of a polyisobuteneamine (Mn=1000) are kneaded with the same amount of hard paraffin (melting point=55° C.) in a kneader (200 ml kneader from Werner & Pfleiderer) for one hour at 20° C.

After this processing stage, the detergent is present in solid form (melting range 35–40° C.).

EXAMPLE 3

Determination of the Clean-up Effect of a Solid Additive Formulation

The novel solid fuel additives are tested, in particular with respect to their suitability as intake valve cleaners, with the aid of engine tests which are carried out in test bed trials with an Opel Kadett engine according to CEC F-04-A-87. The additive prepared according to Example 1b) was added to commercial gasoline fuel in an amount, which corresponds to an amount of 600 mg Keropur/kg of fuel. The results are summarized in Table 1 below.

TABLE 1

| Additive | Dose [mg/kg] | Intake valve deposits [mg/valve] 1 | 2 | 3 | 4 |
|---|---|---|---|---|---|
| Basic value | — | 510 | 277 | 250 | 467 |
| Solid gasoline fuel additive according to Example 1b) | 1200 | 6 | 7 | 9 | 45 |

The test results show that intake valve deposits were substantially reduced in comparison with the basic value in the absence of additives.

EXAMPLES 4 TO 8

Further novel additive formulations were prepared on the basis of the experimental method of Example 1 and were tested for melting behavior, fuel solubility and bleeding. The experimental results determined are summarized in Table 2.

The experimental results determined show that novel highly concentrated stable additive formulations can be prepared in a simple manner from liquid fuel additives.

TABLE 2

| Additive | Mixing ratio Additive: paraffin[5)] | PIBA[7)] [% by wt.] | Consistency [at 20° C.] | Melting range [° C.] | Bleeding[6)] [at 20° C.] | Solubility[4)] [% by wt.] | Example No. |
|---|---|---|---|---|---|---|---|
| Keropur ® | 2:1 | 16.5 | solid | 35–40 | no | 10 | 4 |
| ES 3401[1)] | 4:1 | 20 | pasty | 35–40 | no | 10 | 5 |
| Keropur ® | 2:1 | 16.5 | solid | 35–40 | no | 10 | 1a |
| 3222[2)] | 4:1 | 20 | pasty | 35–40 | no | 10 | 6 |
| Keropur ® | 2:1 | 16.5 | solid | 35–40 | no | 10 | 7 |
| 3131[3)] | 4:1 | 20 | pasty | 35–40 | no | 10 | 8 |

[1)]liquid gasoline fuel additive containing 25% by weight of PIBA (Mn = 1000) in mineral carrier oil composition boiling point > 150° C. density (15° C.) = 0.86 $g/cm^3$ viscosity (20° C.) = 160 $mm^2/s$ TABLE 2-continued

| Additive | Mixing ratio Additive: paraffin[5)] | PIBA[7)] [% by wt.] | Consistency [at 20° C.] | Melting range [° C.] | Bleeding[6)] [at 20° C.] | Solubility[4)] [% by wt.] | Example No. |
|---|---|---|---|---|---|---|---|

[2)]liquid gasoline fuel additive containing 25% by weight of PIBA (Mn = 1000) in carrier oil composition, comprising a mixture of mineral carrier oil and synthetic polyether carrier oil
[3)]liquid gasoline fuel additive containing 25% by weight of PIBA (Mn = 1000) in a mixture of synthetic polyether-based carrier oils; boiling point > 180° C. density (20° C.) = 0.87 g/cm$^3$ viscosity (20° C.) = 70 mm$^2$/s
[4)]determined in gasoline fuel at 20° C.
[5)]commercial hard paraffin; melting point = 55° C.
[6)]visually determined
[7)]polyisobutyleneamine, Mn = 1000

We claim:

1. A fuel additive composition comprising a homogeneous mixture of a solid compacting agent soluble in fuel and at least one liquid fuel additive, the composition having a content of liquid fuel additive of from more than about 40 to about 99% by weight, based on its total weight, being solid or pasty under standard conditions of temperature and pressure, wherein the liquid fuel additive comprises at least one detergent additive, which is selected from the group consisting of polyetheramines and polyalkeneamines and functional derivatives thereof, in an amount of more than about 10% by weight, based on the total weight of the composition.

2. A composition as claimed in claim 1, which melts in the range from about 25 to 95° C.

3. A composition as claimed in claim 1, wherein the detergent additive is selected from polyisobuteneamines, and functional derivatives thereof.

4. A composition as claimed in claim 3, wherein the content of detergent additive is from about 20 to about 100% by weight, based on the total weight of liquid fuel additives contained in the composition.

5. A composition as claimed in claim 4, which contains at least one further additive, selected form the group consisting of corrosion inhibitors, demulsifiers, dyes, and carrier oils.

6. A composition as claimed in claim 1, wherein the compacting agent has a melting point from about 30 to 100° C.

7. A composition as claimed in claim 6, wherein the compacting agent is selected from fuel-soluble natural waxes, chemically modified waxes and synthetic waxes, and mixtures thereof.

8. A composition as claimed in claim 1, wherein the liquid fuel additive comprises about a) 20–80% by weight of at least one polyisobuteneamine as the detergent additive, b) 20–80% be weight of at least one synthetic carrier liquid or one carrier oil based on mineral oil and c) 0–5% by weight of at least one further additive, the stated contents each being based on the total weight of the components a), b) and c) added to the compacting agent.

9. A composition as claimed in claim 1, containing at least one polyisobuteneamine having an Mn of about 150–5000.

10. A composition as claimed in claim 1, fabricated as solid.

11. A composition as claimed in claim 7, wherein the compacting agent is selected from paraffin wax, polyethylene wax, high molecular weight polyisobutene and vaseline, and mixtures thereof.

12. A composition as claimed in claim 1, fabricated as solid uncoated dosage units.

* * * * *